United States Patent [19]

Pernick

[11] Patent Number: 5,016,450

[45] Date of Patent: May 21, 1991

[54] KNIT FABRIC WITH INLAY PILE YARN AND METHOD

[75] Inventor: Bruce M. Pernick, Glendale, N.Y.

[73] Assignee: Monarch Knitting Machinery Corporation, Glendale, N.Y.

[21] Appl. No.: 419,265

[22] Filed: Oct. 10, 1989

[51] Int. Cl.[5] ..... D04B 9/12
[52] U.S. Cl. ..... 66/93; 66/194
[58] Field of Search ..... 66/91, 93, 191, 194

[56] References Cited

U.S. PATENT DOCUMENTS

| | | | |
|---|---|---|---|
| 2,710,527 | 6/1955 | Radin | 66/93 |
| 2,893,226 | 7/1959 | Lombardi | 66/93 |
| 3,111,829 | 11/1963 | Artzt | 66/194 |
| 3,241,337 | 3/1966 | Stevens, Jr. | 66/93 |
| 4,490,995 | 1/1985 | Schmidt | 66/191 |
| 4,537,048 | 8/1985 | Gurschmidt et al. | 66/93 |

FOREIGN PATENT DOCUMENTS

| | | | |
|---|---|---|---|
| 1070543 | 7/1954 | France | 66/91 |

*Primary Examiner*—Werner H. Schroeder
*Assistant Examiner*—John J. Calvert
*Attorney, Agent, or Firm*—Bell, Seltzer, Park & Gibson

[57] ABSTRACT

A body yarn forms plain jersey stitch loops in every needle wale of successive courses of the fabric. Alternating single courses include pile yarn inlaid in alternating single wales of the plain jersey stitch loops of body yarn while pile loops extend inwardly and across intervening single wales of the plain jersey stitch loops of the body yarn. Intervening single courses include pile yarn inlaid in intervening single wales of the plain jersey stitch loops of body yarn while pile loops extend inwardly and across alternating single wales of the plain jersey stitch loops of body yarn. The fabric is knit on a circular multifeed knitting machine with a pair of successive courses being knit as cylinder needles and dial hook elements pass through each successive series of three yarn feeding and knitting stations.

5 Claims, 2 Drawing Sheets

KNIT FABRIC WITH INLAY PILE YARN AND METHOD

FIELD OF THE INVENTION

This invention relates generally to a circular knit pile fabric and method of knitting the same, and more particularly to such a fabric in which pile yarn is inlaid in alternating single wales of alternating single body yarn courses and with pile loops extending inwardly and across intervening single wales, and in which pile yarn is inlaid in intervening single wales of intervening single body yarn courses and with pile loops extending inwardly and across alternating single wales.

BACKGROUND OF THE INVENTION

In the knitting of circular knit pile fabric, it is the normal practice to knit both a pile yarn and a body yarn together in plated relationship at every knitting station while forming pile or terry loops of the pile yarn. The pile or terry loops are formed by advancing sinkers between the cylinder needles so that the pile or terry loops are formed over the upper nibs of the sinkers while the body yarn stitch loops are drawn over the lower stitch drawing ledge of the sinkers. After the terry loops are formed in this manner, the fabric is sheared to produce pile extending outwardly from one surface of the knit fabric. However, the length of the pile or terry loops formed in this manner is limited by the height of the upper nib of the sinkers. This knit fabric is rather heavy and bulky since the pile yarn is knit in plated relationship with the body yarn in the needle loops and it is not possible to easily change the height of the pile or terry loops being formed. Also, the plating of the pile yarn with the body yarn may not be accurately controlled so that portions of the pile yarn may be visible and may extend inwardly on the inside or back of the fabric.

Recognizing these deficiencies of pile fabric formed with the use of sinkers, the Mishcon U.S. Pat. No. 2,796,751 discloses the formation of a circular knit pile fabric by employing hooked loop jacks in the dial of the circular knitting machine so that the height of the pile or terry loops can be varied by merely varying the amount the hooked loop jacks are withdrawn or retracted into the dial, after picking up the pile yarn therein. This patent also discloses eliminating the problem of the plating of the pile yarn with the body yarn by inlaying the pile yarn in the knit fabric formed by the body yarn. However, this patent discloses utilizing half the number of hooked loop jacks as the number of cylinder needles and forming plain jersey stitch loops of body yarn on alternate cylinder needles while forming the pile or terry loops of the pile yarn on every hooked loop jack at each knitting station. The pile fabric produced in accordance with this patent thus includes a pile or terry loop extending inwardly and between every wale of the plain jersey stitch loops of each course of the body yarn.

SUMMARY OF THE INVENTION

With the foregoing in mind, it is an object of the present invention to provide a circular knit pile fabric and method of forming the same wherein the successive courses of body yarn include pile yarn inlaid in every other wale while pile or terry loops extend inwardly and across the remaining wales, and wherein the pile or terry loops in alternating single courses are staggered walewise relative to the pile or terry loops in intervening single courses.

In the illustrated embodiment, the present circular knit pile fabric includes successive courses knit of body yarn and forming plain jersey stitch loops in every needle wale of the successive courses. Alternating single courses include pile yarn inlaid in alternating single wales of the plain jersey stitch loops of body yarn while forming pile or terry loops extending inwardly and across intervening single wales of the plain jersey stitch loops of body yarn. Intervening single courses of the knit pile fabric include pile yarn inlaid in intervening single wales of the plain jersey stitch loops of body yarn while forming pile or terry loops extending inwardly and across alternating single wales of the plain jersey stitch loops of body yarn.

The disclosed method of knitting the circular knit pile fabric is carried out on a circular knitting machine including a plurality of circularly arranged cylinder needles movable vertically between latch clearing and stitch drawing positions. Dial hook elements equal in number to the number of cylinder needles are supported for radial movement relative to the cylinder needles. A plurality of yarn feeding stations is provided around the circularly arranged cylinder needles and yarn feeding fingers are provided for feeding a body yarn to the cylinder needles and a pile yarn to the dial hook elements.

The method includes the steps of raising alternating single cylinder needles to latch clearing position at one feeding station, moving intervening single dial hook elements outwardly between the raised cylinder needles, feeding a pile yarn to the outwardly moved dial hook elements, withdrawing the dial hook elements inwardly between the cylinder needles to form a pile or terry loop thereof, raising the intervening single cylinder needles to latch clearing position and feeding body yarn to all of the cylinder needles, and then lowering all of the cylinder needles to the stitch drawing position to form a first course of fabric with pile yarn inlaid in alternating single wales and while forming pile loops extending inwardly and across intervening single wales of the course of body yarn.

At the next feeding station, the intervening single cylinder needles are raised to latch clearing position, alternating single dial hook elements are moved outwardly between the raised cylinder needles, a pile yarn is fed to the outwardly moved dial hook elements, the dial hook elements are withdrawn inwardly between the cylinder needles to form a pile or terry loop thereof, the alternating single cylinder needles are raised to the latch clearing position and a body yarn is fed to all of the cylinder needles, and then all of the cylinder needles are lowered to the stitch drawing position to form a second course of fabric with pile yarn inlaid in intervening single wales and while forming pile or terry loops extending inwardly and across alternating single wales of the second course of body yarn. These steps are continuously repeated to form the loop pile fabric.

It is preferred that all of the cylinder needles be maintained in the lowered stitch forming position at a third feeding station and all of the dial hook elements be withdrawn inwardly into the dial a sufficient distance to stretch and elongate the pile or terry loops held thereby. The dial hook elements are then moved outwardly to release the pile or terry loops from the dial hook elements and the dial hook elements are withdrawn to position the same to begin another knitting cycle.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENT

Figure 2:
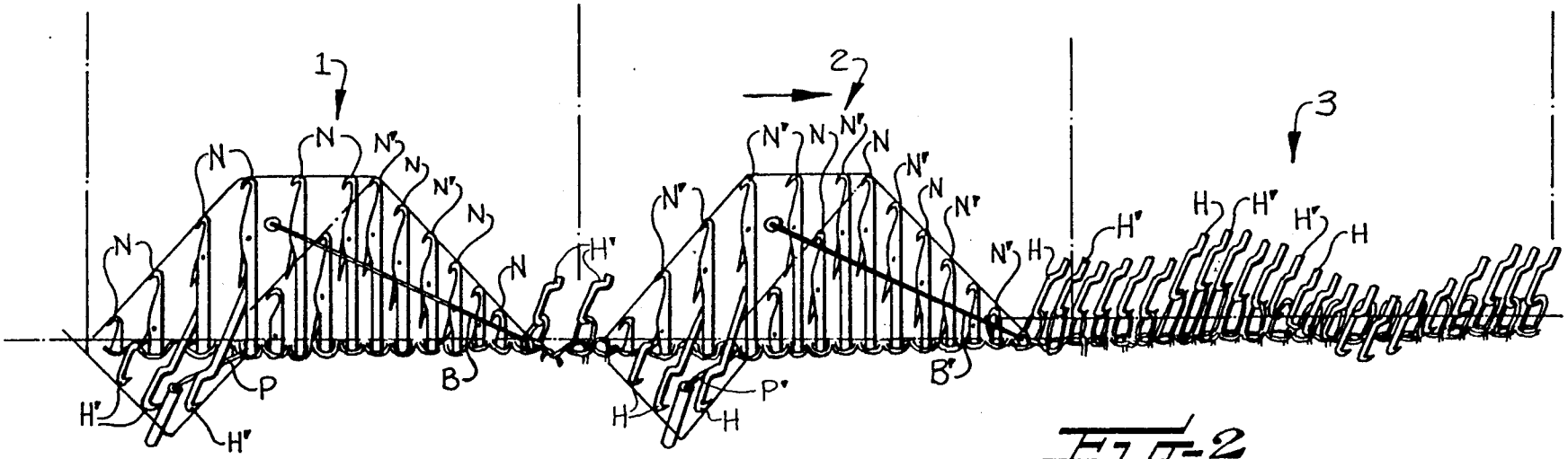
FIG. 2 is a somewhat schematic illustration of the manner in which the cylinder needles and the dial hook elements form the knit pile fabric at three successive feeding stations.
Figure 3:
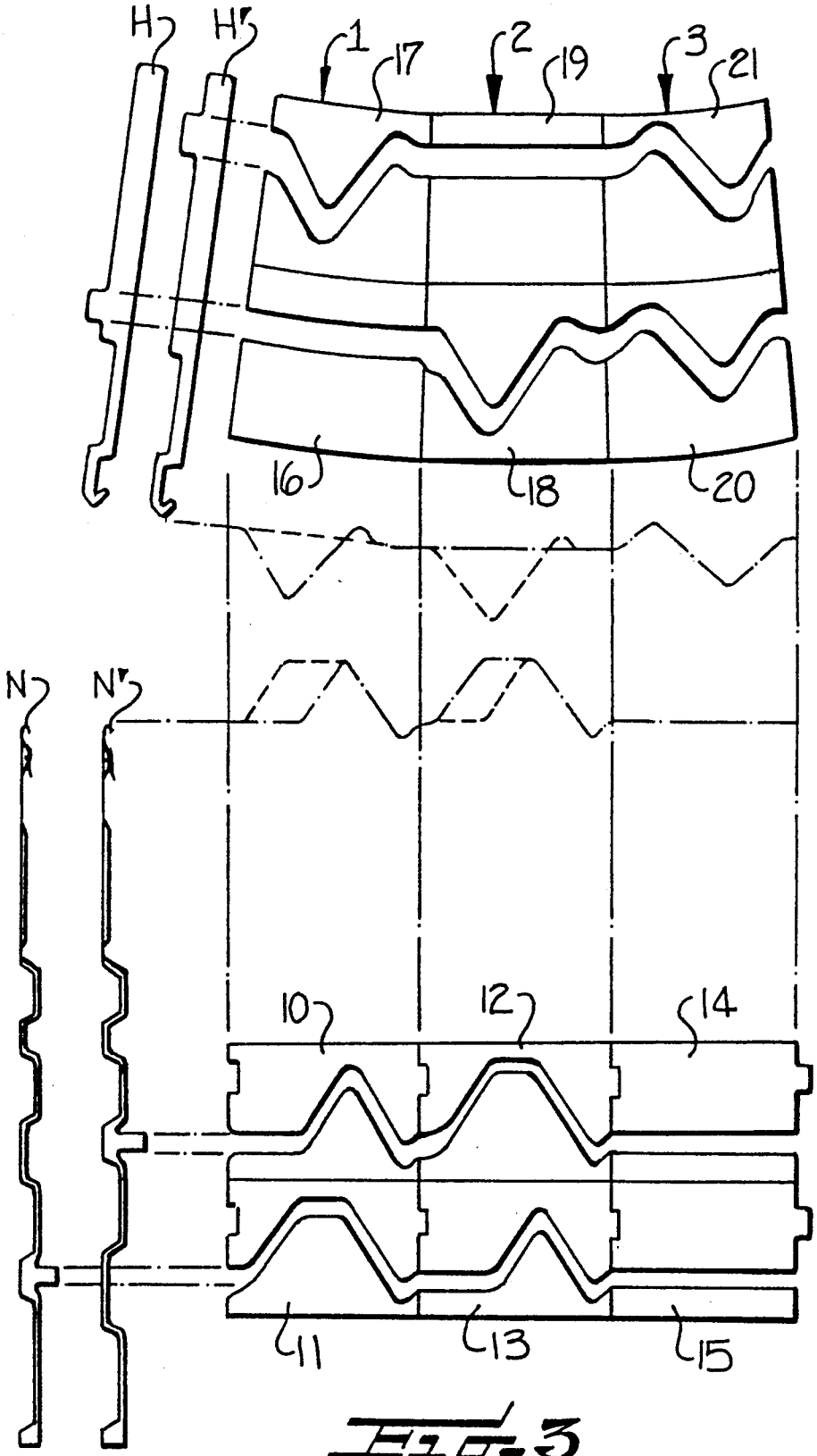
FIG. 3 is a somewhat schematic developed view showing the cam tracks for the cylinder needles and the dial hook elements and the paths of travel followed thereby at three successive feeding stations.

The knit fabric with inlay pile yarn of the present invention is knit on a large diameter circular knitting machine including a plurality of yarn feeding and knitting stations positioned around the needle cylinder and the dial, not shown, as illustrated by the series of yarn feeding stations 1–3 in FIGS. 2 and 3. Low butt cylinder needles N are supported for vertical movement in alternate vertical slots of the needle cylinder (FIG. 3) and intervening single high butt latch needles N′ are supported for vertical movement in intervening vertical slots of the needle cylinder. Alternating single high butt dial hook elements H are supported for radial sliding movement in alternating radial grooves of the dial while intervening single low butt dial hook elements H′ are supported for radial sliding movement in intervening radial grooves of the dial.

As illustrated in FIG. 3, cylinder needle operating cam blocks 10, 11 are provided with needle butt operating cam tracks for controlling the vertical movement of the cylinder needles N, N′ at the first yarn feeding and knitting station 1. Needle butt operating cam blocks 12, 13 are positioned adjacent the needle cylinder and at the second yarn feeding and knitting station 2 while needle butt operating cam blocks 14, 15 are positioned adjacent the needle cylinder and at the yarn feeding and knitting station 3. Dial hook element operating cam blocks 16, 17 are positioned adjacent the dial and at the yarn feeding and knitting station 1. Dial hook element operating cam blocks 18, 19 are positioned adjacent the dial and at yarn feeding and knitting station 2 while dial hook element operating cam blocks 20, 21 are positioned at yarn feeding and knitting station 3.

A yarn feed finger is positioned adjacent the cylinder needles at yarn feeding and knitting station 1 to feed a body yarn B to the cylinder needles while a yarn feeding finger is positioned at yarn feeding and knitting station 2 to feed a body yarn B′ thereto (FIG. 2). A yarn feeding finger is positioned at yarn feeding and knitting station 1 to feed a pile yarn P to the dial hook elements H, H′ while a yarn feeding finger is positioned at yarn feeding and knitting station 2 to feed a pile yarn P′ to the dial hook elements H, H′, in a manner to be presently described. As illustrated in FIG. 2, the number of dial hook elements H, H′ is equal to the number of cylinder needles N, N′ and the intervening single dial hook elements H′ are substantially aligned above the intervening cylinder needles N′ while the alternating single dial hook elements H are substantially aligned with the alternating cylinder needles N.

Method of Knitting

Figure 1:
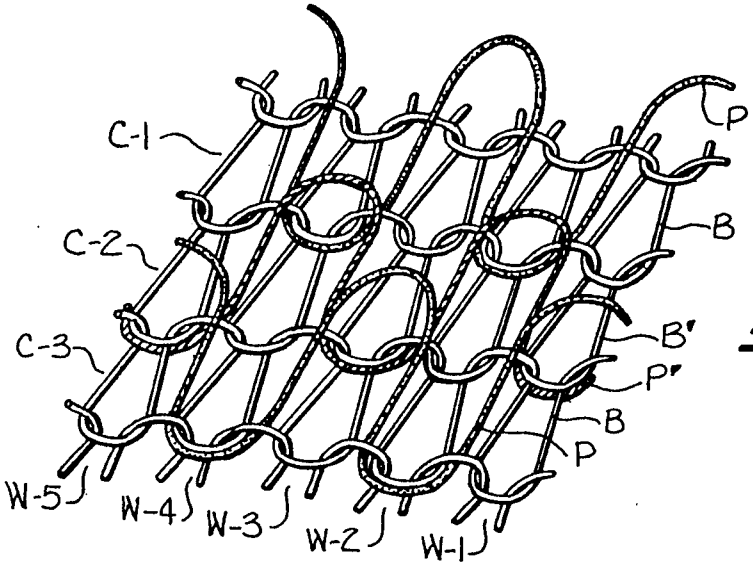
FIG. 1 is a greatly enlarged fragmentary isometric view of the present knit pile fabric illustrating the manner in which the inlaid pile or terry loops are staggered walewise from course to course.

The knit fabric with inlay pile yarn of the present invention, as illustrated in FIG. 1, is knit with the alternating and intervening cylinder needles N, N′ and the alternating and intervening dial hook elements H, H′ moving in a counterclockwise direction or from left to right in FIGS. 2 and 3. Alternating single cylinder needles N are raised to latch clearing position at yarn feeding and knitting station 1 as the low butts thereof engage and are raised upwardly to latch clearing level by the cam track in the cam block 11. As these alternate cylinder needles N are being raised upwardly, the intervening single dial hook elements H′ are moved outwardly by the cam track in the cam block 17 and between the raised cylinder needles N while the pile yarn P is fed to the outwardly moved dial hook elements H′. The single intervening dial hook elements H′ are then withdrawn inwardly between the alternating single cylinder needles N to form a pile loop of the pile yarn P. The intervening single cylinder needles N′ are then raised to the latch clearing position by movement of the high butt along the cam track in the cam block 10. The body yarn B is then fed to all of the cylinder needles N, N′ and all of the cylinder needles are lowered to the stitch drawing position to form body yarn stitch loops in every wale W-1 through W-5 of course C-1 (FIG. 1). The pile yarn P is inlaid in alternating single wales (W-2 and W-4) while forming pile loops extending inwardly and across intervening single wales (W-1, W-3 and W-5) of the course C-1, as illustrated in FIG. 1. The pile loops formed in course C-1 are held on the intervening single dial hook elements H′ while course C-2 is knit at the next yarn feeding and knitting station 2.

At the yarn feeding and knitting station 2, intervening single cylinder needles N′ are first raised to latch clearing position by movement of the high butts of the intervening single cylinder needles N′ along the cam track of the cam block 12. While the intervening single cylinder needles N′ are being raised to latch clearing position at yarn feeding and knitting station 2, alternating single dial hook elements H are moved outwardly between the raised cylinder needles N′ and a pile yarn P′ is fed to the outwardly moved alternating single dial hook elements H. The alternating single dial hook elements H are moved outwardly by the high butts thereof engaging and moving along the cam track of the cam block 18. These alternating single dial hook elements H are then withdrawn or moved inwardly between the cylinder needles N′ to form a pile loop thereof. The alternating single cylinder needles N are then raised to the latch clearing position as their low butts move along the cam track in the cam block 13 and a body yarn B′ is fed to all of the cylinder needles N and N′. All of the cylinder needles N and N′ are then lowered to the stitch drawing position to form the second course C-2 of body yarn B′ with the pile yarn P′ being inlaid in intervening single wales (W-1, W-3 and W-5) and forming pile loops extending inwardly and across alternating single wales (W-2 and W-4) of this second course of fabric C-2. The pile loops of the pile yarn P and pile yarn P′ are held on the withdrawn dial hook elements H and H′ as these elements approach the yarn feeding and knitting station 3.

At the yarn feeding and knitting station 3, all of the cylinder needles N and N' remain in a lowered position as their corresponding butts pass along the straight yarn tracks in the cam blocks 14, 15 (FIG. 3). All of the dial hook elements H and H' are then withdrawn inwardly by their butts engaging and moving along the cam tracks in the cam blocks 20, 21 to stretch the pile loops held in the hooks thereof and to insure that the inlaid portions of the pile yarns P and P' are drawn into close engagement with the corresponding body yarn stitch loops. This inward movement of the pile loops to stretch the same also insures that the pile loops will stand upwardly in a straight manner from the courses of body yarn fabric. After all of the dial hook elements H and H' have been moved inwardly to stretch the pile loops, the dial hook elements H and H' are all moved outwardly to release the pile loops from the hooks thereof. The dial hook elements H, H' are then moved inwardly, after the pile loops have been released therefrom.

Thus, two courses of fabric are knit as the needles N, N' and the dial hock elements H, H' pass the three yarn feeding and knitting stations 1, 2 and 3. As the needles N, N' and the dial hook elements H, H' pass the additional series of yarn feeding and knitting stations, not shown, surrounding the needle cylinder and dial, successive pairs of courses are knit at each group of yarn feeding and knitting stations.

As illustrated in FIG. 1, the circular knit pile fabric of the present invention includes successive courses C-1 through C-3 knit of body yarns B, B' and forming plain jersey stitch loops in every needle wale (W-1 through W-5). Alternating single courses (C-1 and C-3) include pile yarn P inlaid in alternating single wales (W-2, W-4) of the plain jersey stitch loops of body yarn B and pile loops extending inwardly of the machine direction and across intervening single wales (W-1, W-3 and W-5) of the plain jersey stitch loops of body yarn. Intervening single courses (C-2) include pile yarn P' inlaid in intervening single wales (W-1, W-3 and W-5) and forming pile loops extending inwardly of the machine direction and across intervening single wales (W-2, W-4) of the plain jersey stitch loops of body yarn B'. Thus, the pile loops formed in alternating single wales of the alternating single courses (C-1, C-3) are staggered relative to the pile loops formed in the intervening single courses (C-2). As shown in FIG. 1, the inwardly extending pile loops are free from the body yarn stitch loops and are of a substantially greater length than the body yarn stitch loops, illustrated as being substantially twice the length of the adjacent body yarn stitch loops.

As shown in the drawings, particularly FIG. 2, the fabric of FIG. 1 is formed at the two knitting stations 1, 2 and the pile loops are released from the dial hook elements H and H' at the third knitting station 3. If desired, it is also possible to knit the fabric on two knitting stations instead of three knitting stations. In one case, the two knitting station method would be carried out by starting to move all dial hook elements H and H' outwardly at the first knitting station and then withdrawing the dial hook elements H before they reach the point at which the pile yarn P is picked up, while the dial hook elements H' continue outward movement to pick up the pile yarn P and form pile loops thereon.

In the other case, the two knitting station method would be carried out by forming pile loops of the yarn P on the dial hook elements H' at the first knitting station and forming pile loops of the yarn P' on the dial hook elements H at the second knitting station. The pile loops of the yarn P' held on the dial hook elements H are shed as the dial hook elements H are moved outwardly at the second knitting station, while the pile loops of the yarn P (held on the dial hook elements H') are shed as the dial hook elements H' are moved outwardly at the first knitting station. If the fabric is knit by this two knitting station manner, the fabric can be produced at a faster rate, because of the reduced number of knitting stations required.

In the knitting of the fabric by any of the described methods, the knit fabric with inlay pile yarn of the present invention utilizes a lesser length of the pile yarn than would be the case if the pile yarn were knit in plated relationship with the body yarn, as is the common practice. Also, the formation of pile loops in every other wale of each course of the fabric provides a saving in the length of pile yarn used while providing a sufficiently thick and heavy number of pile loops to provide a thick pile, when the pile loops are sheared in the usual manner.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A circular knit pile fabric including successive courses knot of body yarn and forming plain jersey stitch loops in every needle wale of said successive courses, alternating single courses including pile yarn inlaid in alternating single wales of the plain jersey stitch loops of body yarn and forming pile loops extending inwardly of the machine direction and across intervening single wales of the plain jersey stitch loops of body yarn, and intervening single courses including pile yarn inlaid in intervening single wales of the plain jersey stitch loops of body yarn and forming pile loops extending inwardly of the machine direction and across alternating single wales of the plain jersey stitch loops of body yarn, said inwardly extending pile loops being free from said body yarn stitch loops and being of a substantially greater length than said body yarn stitch loops.

2. A method of knitting a pile loop fabric on a circular knitting machine including a plurality of circularly arranged cylinder needles movable vertically between latch clearing and stitch drawing positions, dial hook elements equal in number to the number of said cylinder needles and being movable radially of said cylinder needles, and a plurality of yarn feeding stations positioned around the circularly arranged cylinder needles, said method comprising the steps of raising alternating single cylinder needles to latch clearing position at one feeding station, moving intervening single dial hook elements outwardly between the raised cylinder needles, feeding a pile yarn to the outwardly moved dial hook elements, withdrawing the intervening single dial hook elements inwardly between the cylinder needles to form a pile loop thereof, raising the intervening single cylinder needles to the latch clearing position and feeding body yarn to all of the cylinder needles, lowering all of the cylinder needled to the stitch drawing position to form a first course of fabric with pile yarn inlaid in alternating single wales and while forming pile loops extending inwardly and across intervening single wales of the course of body yarn, raising intervening single cylinder needles to latch clearing position at the next feeding station, moving alternating single dial hook elements outwardly between the raised cylinder needles, feeding a pile yarn to the outwardly moved dial hook elements, withdrawing the dial hook elements inwardly between the cylinder needles to form a pile loop thereof, raising the alternating single cylinder needles to the latch clearing position and feeding body yarn to all of the cylinder needles, lowering all of the cylinder needles to the stitch drawing position to form a second course of fabric with pile yarn inlaid in intervening single wales and while forming pile loops extending inwardly and across alternating single wales of the course of body yarn.

3. A method of knitting according to claim 2 wherein said intervening dial hook elements are maintained in the withdrawn position and hold the pile loops thereon as they pass said next feeding station.

4. A method of knitting according to claim 3 including the additional step of moving all of the dial hook elements outwardly at a third feeding station to release the pile loops from the dial hook elements.

5. A method of knitting according to claim 2 including the additional steps of withdrawing the dial hook elements inwardly at a third feeding station while maintaining all of the cylinder needles in a lowered position to stretch the pile loops held in the dial hook elements, and then moving all of the dial hook elements outwardly to release the stretched pile loops from the dial hook elements.

* * * * *